US006792867B1

(12) United States Patent
Jorgensen et al.

(10) Patent No.: US 6,792,867 B1
(45) Date of Patent: Sep. 21, 2004

(54) METHOD FOR PRODUCING CHEMICAL ENERGY

(75) Inventors: Betty S. Jorgensen, Jemez Springs, NM (US); Wayne C. Danen, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/678,670

(22) Filed: Oct. 2, 2003

Related U.S. Application Data

(62) Division of application No. 10/087,883, filed on Feb. 28, 2002, now abandoned.

(51) Int. Cl.[7] ..... F42B 4/00

(52) U.S. Cl. ..... 102/335; 149/6; 149/7; 149/37; 149/44

(58) Field of Search ..... 102/335; 149/6, 149/7, 37, 44

(56) References Cited

U.S. PATENT DOCUMENTS

| | | | | |
|---|---|---|---|---|
| 3,523,839 | A | 8/1970 | Schechter et al. | 149/7 |
| RE27,025 | E | 1/1971 | McDonald | 149/7 |
| 4,115,165 | A | 9/1978 | Machacek | 149/5 |
| 4,376,083 | A | 3/1983 | Ulsteen | 264/3 D |
| 4,689,250 | A | 8/1987 | Quella et al. | 427/216 |
| 5,266,132 | A | 11/1993 | Danen et al. | 149/15 |
| 5,424,129 | A | 6/1995 | Lewis et al. | 428/403 |
| 5,445,886 | A | 8/1995 | Ogawa | 428/403 |
| 5,451,277 | A | 9/1995 | Katzakian et al. | 149/19.92 |
| 5,606,146 | A | 2/1997 | Danen et al. | 149/15 |
| 5,717,159 | A | 2/1998 | Dixon et al. | 149/40 |
| 6,143,417 | A | 11/2000 | Nomura et al. | 428/425.6 |
| 6,183,558 | B1 | 2/2001 | Otake et al. | 118/65 |

*Primary Examiner*—Edward A. Miller
(74) *Attorney, Agent, or Firm*—Samuel L. Borkowsky

(57) ABSTRACT

Fluoroalkylsilane-coated metal particles having a central metal core, a buffer layer surrounding the core, and a fluoroalkylsilane layer attached to the buffer layer are prepared by combining a chemically reactive fluoroalkylsilane compound with an oxide coated metal particle having a hydroxylated surface. The resulting fluoroalkylsilane layer that coats the particles provides them with excellent resistance to aging. The particles can be blended with oxidant particles to form energetic powder that releases chemical energy when the buffer layer is physically disrupted so that the reductant metal core can react with the oxidant.

8 Claims, 2 Drawing Sheets

METHOD FOR PRODUCING CHEMICAL ENERGY

RELATED CASES

This application is a divisional of patent application Ser. No. 10/087,883, filed Feb. 28, 2002, hereby incorporated by reference, now abandoned.

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to coated metal particles and more particularly to particles having a central metal core, a buffer layer surrounding the core, and a fluoroalkylsilane layer covalently attached to the buffer layer.

BACKGROUND OF THE INVENTION

Explosives are energetic materials that typically include an oxidant and a reductant that react rapidly with each other to produce product gases (e.g. $CO_2$, $H_2O$, and others) and energy in the form of heat and shock. Explosives include materials such as TNT, TATB, RDX, nitroglycerine, and the like, which produce energy at a very fast and uncontrolled rate. For applications that require a more controlled rate of energy production, "metastable intersitital composite" (MIC) materials have been developed.

MIC materials have been described, for example, in U.S. Pat. No. 5,266,132 to W. C. Danen et al. entitled "Energetic Composites," and in U.S. Pat. No. 5,606,146 to W. C. Danen et al. entitled "Energetic Composites and Method of Providing Chemical Energy," both hereby incorporated by reference. The MIC materials described in the '132 and '146 patents are layered materials that include alternating layers of oxidant and reductant. The oxidant layers are physically separated from the reductant layers by buffer layers. When the buffer layers are disrupted, the oxidant and reductant layers come into contact and react to produce chemical energy. The amount of energy produced and the rate of energy production depend on, among other things, the chemical composition of the oxidant and reductant layers and the number and thickness of these layers.

MIC materials in the form of powders are also known (see U.S. Pat. No. 5,717,159 to G. Dixon et al. entitled "Lead-Free Percussion Primer Mixes Based on Metastable Interstitial Composite (MIC) Technology," hereby incorporated by reference). The MIC powders of the '159 patent are a blend of oxidant powder and reductant powder. The powders are used as percussion primers. The reductant powder is aluminum powder made up of aluminum particles having a thin oxide coating. One percussion primer composition is a mixture of about 45 wt % of reductant aluminum powder and about 55 wt % of oxidant molybdenum trioxide powder. Another primer composition is a mixture of about 50 wt % aluminum powder and about 50 wt % polytetrafluoroethylene. The particle sizes are less than 0.1 micron, and preferably from about 200–500 Angstroms.

A problem common to these known MIC materials is their susceptibility to degradation upon aging, which typically involves the slow oxidation of reactive metal reductant to the corresponding unreactive metal oxide. Using a MIC powder composition that includes aluminum powder and molybdenum trioxide as a example, as more of the aluminum metal degrades and is converted to unreactive aluminum oxide, less aluminum is available for reaction with molybdenum trioxide. Thus, aging through oxidative degradation of reductant metal powder reduces the shelf life and performance of MIC materials. To ensure that the performance of these types of materials is maintained during storage and under conditions that promote degradation, there remains a need for MIC materials and MIC components that are more resistant to degradation.

Therefore, an object of the present invention is to provide MIC materials that are more resistant to degradation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes powder particles having a central metal core, a buffer layer surrounding the central metal core, and a fluoroalkylsilane layer surrounding and covalently bonded to the buffer layer.

The invention also includes energetic powder. The energetic powder is a blend of reductant powder and oxidant powder. The reductant powder includes particles having a central metal core, a buffer layer surrounding the central metal core, and a fluoroalkylsilane layer surrounding and covalently bonded to the buffer layer. The oxidant powder includes oxidant powder particles that chemically react with the reductant powder particles to release chemical energy.

The invention also includes a method of releasing energy. The method involves providing energetic powder particles having a central metal core, a buffer layer surrounding the central metal core, and a fluoroalkylsilane layer that surrounds and is covalently bonded to the buffer layer. When the buffer layer is disrupted, the metal core contacts and chemically reacts with the fluoroalkylsilane layer to release chemical energy.

The invention also includes a method of releasing chemical energy. The method involves providing an energetic powder that includes an oxidant powder blended with a reductant powder. The reductant powder includes particles having a central metal core, a buffer layer that surrounds the central metal core, and a fluoroalkylsilane layer that surrounds and is covalently bonded to the buffer layer. Disrupting the buffer layer brings the metal core and oxidant powder into contact so that they can chemically react and release energy.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION OF THE INVENTION

Figure 1:
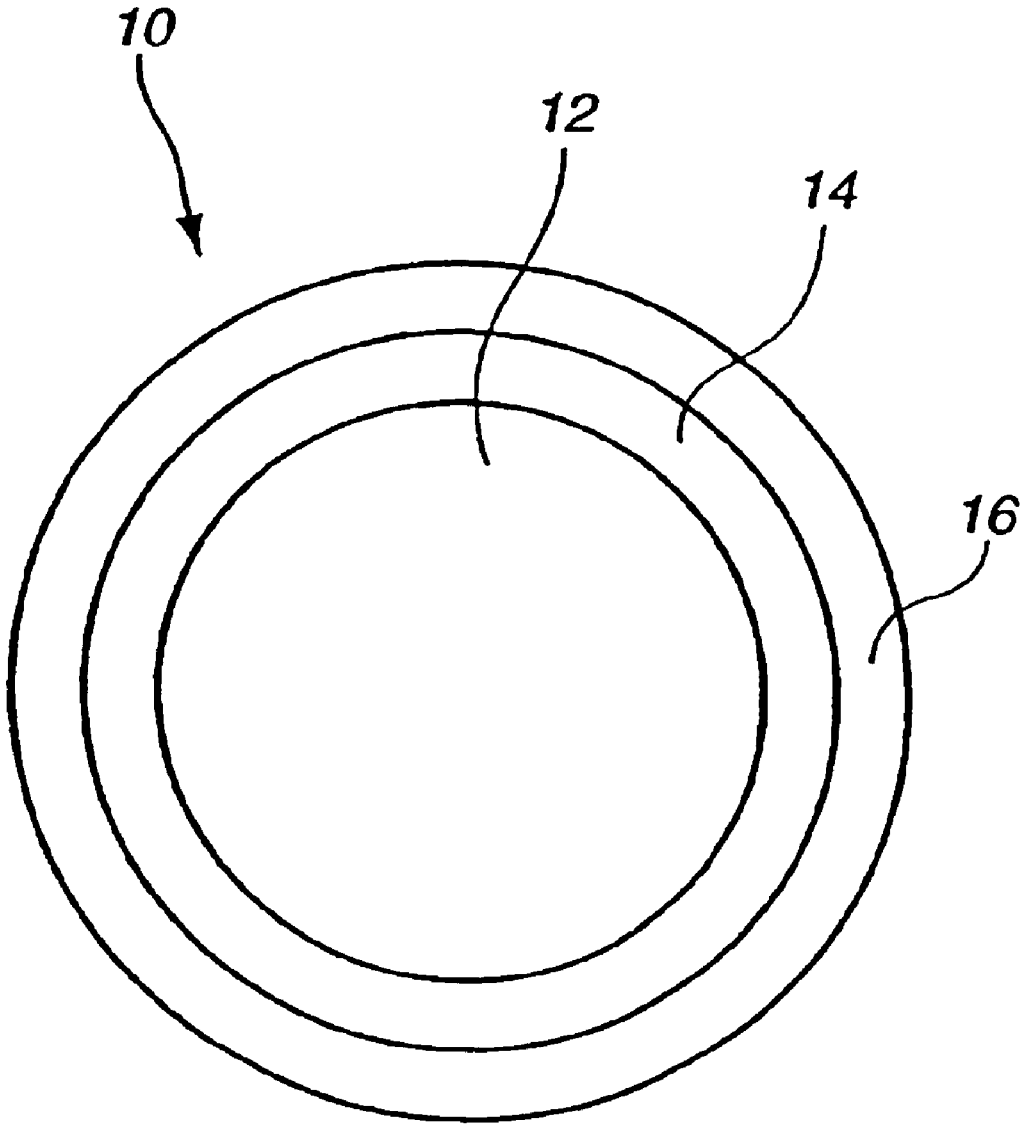
FIG. 1 shows a schematic cross-sectional representation of a powder particle of the present invention.

The present invention includes powder particles having a central metal core, a buffer layer surrounding the core, and an outermost layer of fluoroalkylsilane attached to the buffer layer. The fluoroalkylsilane layer, which is separated from the core by the buffer layer, prevents aging and degradation of the metal core. The fluoroalkylsilane layer may also serve as an oxidant and react with the reductant metal core upon disruption of the buffer layer to release chemical energy. Generally, the fluoroalkylsilane-coated particles include less than the stoichiometric number of fluoroalkyl groups compared to number of reductant metal atoms of the metal core. Thus, the particles are generally not used as stand-alone energetic particles but are usually mixed with particles of a separate oxidizer to form an energetic powder blend similar to the percussion primer compositions described in aforementioned U.S. Pat. No. 5,717,159. It is believed that the particles of the invention differ from known coated-metal particles in the nature of attachment of the coating; the covalent attachment ensures that the fluororalkylsilane layer remains attached to the buffer layer until the buffer layer is disrupted. It is also believed that the fluoroalkylsilane coating provides these particles with a resistance to oxidative degradation greater than that typically seen for known, coated metal particles.

Oxide-coated metal particles are well known (see, for example C. E. Aumann et al. in "Oxidation Behavior of Aluminum Nanopowders," J. Vac. Sci. Technol. B, vol. 13, no. 3, May/June 1995; and C. G. Granqvist et al. in "Ultrafine Metal Particles," J. Appl. Physics, vol. 47, no. 5, May 1976, both incorporated by reference). Oxide coated metal particles of the type described by Aumann et al., Granqvist et al., and others, can be used to prepare the fluoroalkylsilane-coated metal powder particles of the invention.

Fluoroalkylsilane-coated surfaces are also known (see, for example, S. R. Wasserman et al. in "Structure and Reactivity of Alkylsiloxane Monolayers Formed by Reaction of Alkyltrichlorosilanes on Silicon Substrates, Langmuir, vol. 5, pp. 1074–1087, 1989; R. Banga et al. in "FTIR and AFM Studies of the Kinetics and Self-Assembly of Alkyltrichlorosilanes and (Perfluoroalkyl)trichlorosilanes on Glass and Silicon," Langmuir, vol. 11, pp. 4393–4399, 1995; A. Hozumi et al. in "Fluoroalkylsilane Monolayers Formed by Chemical Vapor Surface Modification on Hydroxylated Oxide Surfaces," Langmuir, vol. 15, pp. 7600–7604, 1999, all hereby incorporated by reference). Fluoroalkylsilanes are used in producing coated glass, and the resulting fluoroalkylsilane-coated glass is extremely water resistant (see, for example, U.S. Pat. No. 6,143,417 to T. Nomura et al. entitled "Contamination-Resistant Float Glass", and U.S. Pat. No. 6,183,558 to T. Otake et al. entitled "Method and Apparatus for Producing Molecular Film" both incorporated by reference). Fluoroalkylsilanes used by Nomura, Otake, Wasserman, Banga, and others may be used to prepare the fluroralkylsilane-coated powder particles of the invention.

The practice of the invention can be further understood with the accompanying figures. Similar or identical structure is identified using identical callouts. Turning now to the figures, FIG. 1 shows a schematic cross-sectional representation of a powder particle of the present invention. Particle 10 includes central metal core 12, buffer layer 14 that surrounds core 12, and fluoroalkylsilane layer 16 that surrounds and is covalently bonded to buffer layer 14.

Figure 2:
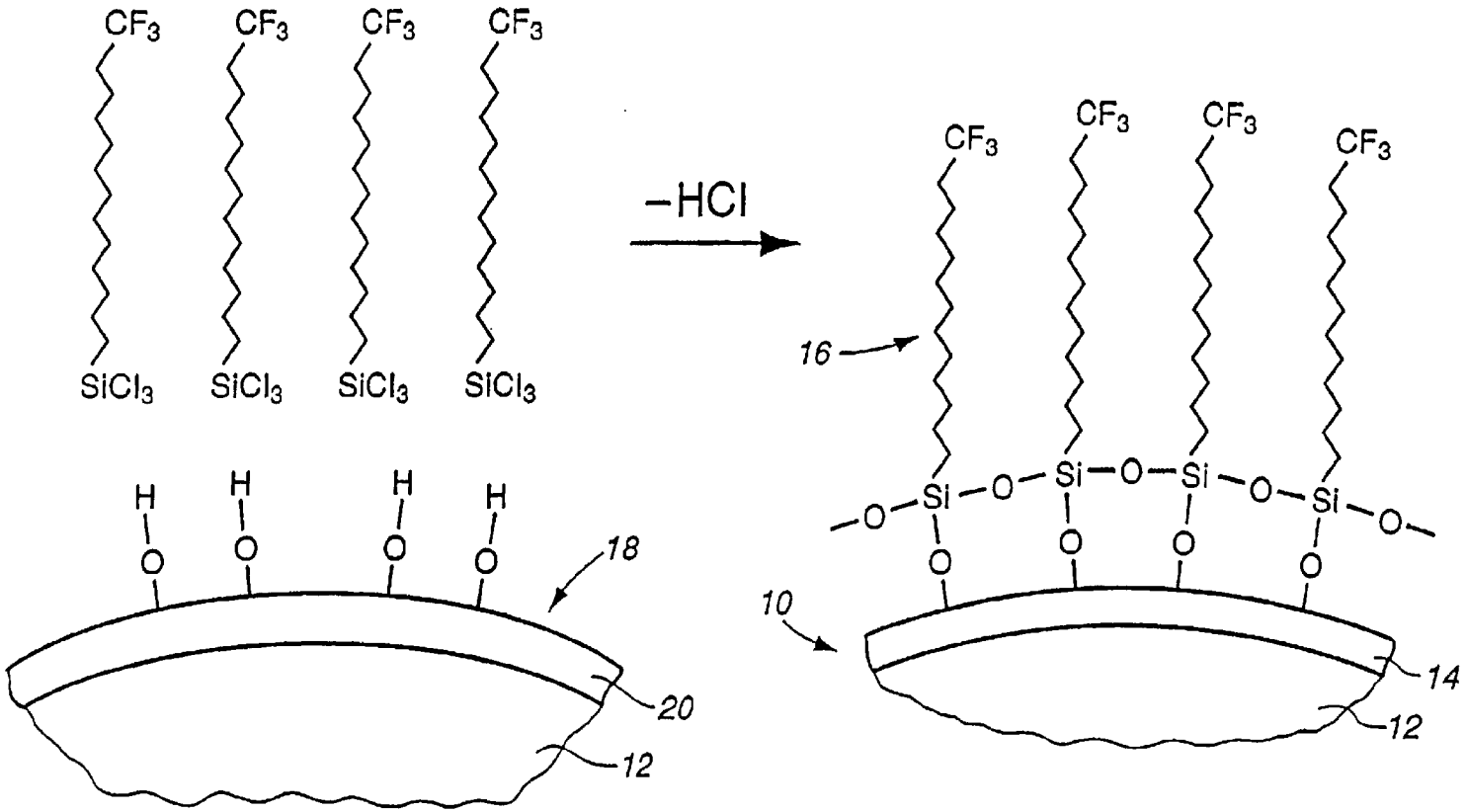
FIG. 2 shows a schematic, molecular scale, sectional representation of the formation of a powder particle of the invention.

FIG. 2 shows a schematic, molecular scale, sectional representation of the formation of particle 10. FIG. 2 shows a small portion of oxide-coated metal particle 18 and a small portion of coated particle 10. As FIG. 2 shows, precursor oxide-coated metal particle 18 has a central metal core 12 surrounded by a thin oxide layer 20 bearing surface hydroxyl groups. It is believed that these hydroxyl groups chemically react with a reactive fluoroalkysilane compound, such as the fluoroalkyltrichlorosilane shown in FIG. 2, to produce the powder particles of the invention. Each molecule of fluoroalkyltrichlorosilane forms a maximum of three siloxane (Si—O) bonds while releasing three molecules of HCl during the reaction with the hydroxyl groups. Without the intention of being limited to any particular type of bonding scheme, an attempt is made to show some of the many possibilities of how the fluoroalkylsilane layer can be attached to the buffer layer. As shown in FIG. 2, each fluoroalkylsilane molecule has attached itself to the buffer layer with one siloxane bond and to adjacent molecules also with siloxane bonds to form the portion of the fluoroalkylsilane layer shown. Other portions of the layer, not shown, may be attached using fewer siloxane bonds to the buffer layer. In fact, it should be possible to attach large portions of the layer with only a single siloxane bond. A single fluoroalkylsilane molecule, for example, could first be attached to the buffer layer and serve as single point of attachment for growing a pendent fluoroalkylpolysiloxane polymer chain.

A specific example of a fluoroalkylsilane-based compound that can be reacted with an oxide-coated metal to produce particles of the invention is given by the formula $$C_nF_{2n+1}(Q)SiXYZ$$

wherein n is an integer of about 1–30; wherein Q represents a $(CH_2)_m$ group wherein m is an integer of about 0–6, a vinyl group, an ethynyl group, an aryl group, or a group including a silicon atom or an oxygen atom; wherein X represents chloride, bromide, iodide or an alkoxyl group such as methoxyl, ethoxyl, or the like; wherein Y represents an alkyl group, a halogen group, an alkoxyl group, a fluoroalkyl group, or a fluoroalkoxyl group; and wherein Z represents a fluoroalkyl group, a fluoroalkoxyl group, or a halogen group.

Preferably, the fluoroalkylsilane-based compound is represented by the formula $$C_nF_{2n+1}(CH_2)_2SiX_3$$

wherein n is equal to a positive integer of about 1–30, and wherein X represents chloride, bromide, iodide, an alkoxyl group such as methoxyl, ethoxyl or the like, or combinations of chloride, bromide, iodide, and alkoxyl groups.

More preferably, the fluoroalkylsilane-based compound is represented by the formula $$CF_3(CF_2)_n(CH_2)_2SiX_3$$

wherein n is equal to a positive integer of about 1–30, and wherein X represents chloride, bromide, iodide, an alkoxyl group such as methoxyl, ethoxyl, or the like, or combinations of chloride, bromide, iodide, and alkoxyl groups. Specific examples of compounds having this formula that can be used to produce powder particles of the invention include the following:

$$CF_3(CF_2)_7(CH_2)_2SiCl_3 \quad [1]$$

$$CF_3(CF_2)_8(CH_2)_2SiCl_3 \quad [2];$$

$$CF_3(CF_2)_9(CH_2)_2SiCl_3 \quad [3];$$

$$CF_3(CF_2)_{10}(CH_2)_2SiCl_3 \quad [4];$$

$CF_3(CF_2)_{11}(CH_2)_2SiCl_3$ [5];

$CF_3(CF_2)_{13}(CH_2)_2SiCl_3$ [6]; and $CF_3(CF_2)_{15}(CH_2)_2SiCl_3$ [7].

Each of compounds [1] through [7] has three reactive Si—Cl bonds. Compounds having three reactive Si—X bonds are preferred because they can form the maximum number (i.e. three) of siloxane bonds and produce a networked fluoroalkylsilane layer that is strongly attached to the buffer layer.

It is expected that fluoroalkylsilane-based compounds having two leaving groups can also be used to form powder particles of the invention. Examples of these types of compounds include:

$CF_3(CF_2)_7(CH_2)_2Si(CH_3)Cl_2$ [8]

$CF_3(CF_2)_8(CH_2)_2Si(CH_3)Cl_2$ [9];

$CF_3(CF_2)_9(CH_2)_2Si(CH_3)Cl_2$ [10];

$CF_3(CF_2)_{10}(CH_2)_2Si(CH_3)Cl_2$ [11];

$CF_3(CF_2)_{11}(CH_2)_2Si(CH_3)Cl_2$ [12];

$CF_3(CF_2)_{13}(CH_2)_2Si(CH_3)Cl_2$ [13]; and $CF_3(CF_2)_{15}(CH_2)_2Si(CH_3)Cl_2$ [14].

It is also expected that fluoroalkylsilane-based compounds having one leaving group can also be used to form particles of the invention. Examples of these compounds include:

$CF_3(CF_2)_7(CH_2)_2Si(CH_3)_2Cl$ [15]

$CF_3(CF_2)_8(CH_2)_2Si(CH_3)_2Cl$ [16];

$CF_3(CF_2)_9(CH_2)_2Si(CH_3)_2Cl$ [17];

$CF_3(CF_2)_{10}(CH_2)_2Si(CH_3)_2Cl$ [18];

$CF_3(CF_2)_{11}(CH_2)_2Si(CH_3)_2Cl$ [19];

$CF_3(CF_2)_{13}(CH_2)_2Si(CH_3)_2Cl$ [20]; and $CF_3(CF_2)_{15}(CH_2)_2Si(CH_3)_2Cl$ [21].

It is expected that fluoroarylsilane-based compounds can also be used to prepare powder particles of the present invention. Examples of fluoroarylsilane-based compounds that are expected to provide particles of the invention include:

$C_6F_5(CH_2)_2SiCl_3$ [22];

$C_6F_5Si(CH_3)_2Cl$ [23]; and $C_6F_5(CH_2)_2Si(CH_3)_2Cl$ [24].

The following example is illustrative of the procedure used to prepare fluroralkylsilane-coated powder particles of the invention.

EXAMPLE

A suspension of oxide-coated aluminum nano-sized powder particles is (0.75 g, particle diameter 20–40 nm, oxide coating diameter about 1.5–3 nm) anhydrous isooctane (35 ml) and methylene chloride (15 ml) was prepared. Heptadecafluoro-1,1,2,2-tetrahydrodecyltrichlorosilane (0.042 ml) was added and the mixture was stirred for 1 hour. The liquid was decanted and the particles were washed with hexane, centrifuged, and the hexane was decanted. Washing followed by decantation was repeated with hexane and then with methylene chloride, and the energetic product fluoroalkylsilane-coated nanoparticles were dried in air. These fluoroalkylsilane-coated particles were blended with particles of molybdenum trioxide ($MoO_3$) powder (available from Climax Corporation) to produce a very energetic MIC powder. Energy was rapidly released from the powder blend when the powder blend was subjected to friction, impact, or spark initiation.

It is believed if a sufficient amount of fluoroalkyl groups are incorporated into the fluoroalkylsilane coating, the resulting particles may be stand-alone energetic particles that are capable of releasing chemical energy without the need of additional oxidant particles. For an aluminum-coated particle, the chemical reaction that is responsible for the energy released is believed to be described by equation (1) below:

$$4Al+3/n(—CF_2CF_2—)_n \rightarrow 4AlF_3+6C \quad (1)$$

The estimated heat of reaction (AH) of equation (1) is −2.10 kcal per gram of Al. When this chemical reaction occurs in air, additional energy may released from the reaction of oxygen with the carbon generated by equation (1) according to equation (2)

$$C+O_2 \rightarrow CO_2 \quad (2)$$

Equation (2) has an estimated heat of reaction of −3.48 keal per gram of carbon. The estimated energy for other particles can also be determined experimentally or theoretically using known bond enthalpies. Oxide-coated metal particles for most metals are known. It should be understood that other metals besides Al can be used to form energetic particles of the invention. Elemental metals that include Al, Ti, Zr, Hf, V, Nb, Ta, Cr, Mo, W, Mn, Tc, Re, Fe, Ru, Os, Ni, Cu, Ag, Zn, Mg, Cd, Li, Na, K, Rb, Cs, Fr, Ba, Ca, Be, B, Ga, In, and TI can be used. Mixtures or alloys of these metals can also be used. Metal particles are typically coated with a thin layer of the corresponding metal oxide that is transformed into the buffer layer of the particles of the invention upon attachment of the fluoroalkylsilane coating. Thus, buffer layers that include oxides of Al, Ti, Zr, Hf, V, Nb, Ta, Cr, Mo, W, Mn, Tc, Re, Fe, Ru, Os, Ni, Cu, Ag, Zn, Mg, Cd, Li, Na, K, Rb, Cs, Fr, Ba, Ca, Ba, B, Ga, In, and TI can be used. Also, mixtures of these oxides can be used as buffer layers.

Generally, any solvent that dissolves the fluoroalkylsilane-based compound and that allows the formation and attachment of the fluoroalkylsilane layer can also be used to prepare particles of the invention. Halocarbon-based solvents, alkylsiloxane-based solvents, and silicone oil-based solvents, to name a few, can be used.

The rate of energy production for energetic powder of the invention is adjustable, at least partly, by the choice of particle size of the precursor oxide-coated metal particle. Oxide-coated particles of most metals are available in a wide range of sizes. Larger oxide-coated metal particles having sizes of tens to hundreds of microns can be used to produce fluoroalkylsilane-oated particles of the invention. However, smaller oxide-coated metal nanoparticles and s microparticles particles are preferred because it is believed that they tend to form energetic blended powders that release chemical energy at a fast rate.

The foregoing description of the invention has been presented for purposes of illustration and description and is not intended to be exhaustive or to limit the invention to the precise form disclosed, and obviously many modifications and variations are possible in light of the above teaching.

The embodiment(s) were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of releasing chemical energy, comprising the steps of:

(a) providing a energetic powder comprising an oxidant powder blended with a reductant powder, wherein the reductant powder comprises particles having a central metal core, a buffer layer that surrounds the central metal core, and a fluoroalkylsilane layer that surrounds and is covalently bonded to the buffer layer; and (b) disrupting the buffer layer so that the reducant powder and oxidant powder chemically react and release energy.

2. The method of claim 1, wherein the central metal core comprises Ti, Zr, Hf, V, Nb, Ta, Cr, Mo, W, Mn, Tc, Re, Fe, Ru, Os, Ni, Cu, Ag, Zn, Mg, Cd, Li, Na, K, Rb, Cs, Fr, Ba, Ca, Be, B, Al, Ga, In, Tl, or mixtures thereof.

3. The method of claim 1, wherein the buffer layer comprises titanium oxide, zirconium oxide, halfnium oxide, vanadium oxide, niobium oxide, tantalum oxide, chromium oxide, molybdenum oxide, tungsten oxide, manganese oxide, techetium oxide, rhenium oxide, iron oxide, ruthenium oxide, osmium oxide, nickel oxide, copper oxide, silver oxide, zinc oxide, magnesium oxide, cadmium oxide, lithium oxide, sodium oxide, potassium oxide, rubidium oxide, cesium oxide, francium oxide, barium oxide, calcium oxide, beryllium oxide, boron oxide, aluminum oxide, gallium oxide, indium oxide, tellurium oxide, and mixtures thereof.

4. The method of claim 1, wherein the fluoroalkylsilane layer comprises a material represented by the formula $$C_nF_{2n+1}(Q)Si(O)YZ,$$

wherein n is an integer of about 1–30; wherein Q represents a $(CH_2)_m$ group wherein m is an integer of about 0–6, a vinyl group, an ethynyl group, an aryl group, or a group including a silicon atom or an oxygen atom; Y represents oxygen, an alkyl group, an aryl group, a fluoroalkyl group, or a fluoroaryl group; and Z represents oxygen, an alkyl group, a fluoroalkyl group, or a fluoroaryl group.

5. The method of claim 1, wherein the fluoroalkylsilane layer comprises a material represented by the formula $$C_nF_{2n+1}(CH_2)_2SiOYZ$$

wherein n is equal to a positive integer of about 1–30, and wherein Y represents oxygen, an alkyl group, an aryl group, a fluoroalkyl group, or a fluoroaryl group; and Z represents oxygen, an alkyl group, a fluoroalkyl group, or a fluoroaryl group.

6. The method of claim 1, wherein said fluoroalkylsilane layer comprises a material represented by the formula $$CF_3(CF_2)_n(CH_2)_2SiO_3$$

wherein n is an integer of about 1–30.

7. The method of claim 1, wherein the central metal core comprises aluminum and the buffer layer comprises aluminum oxide.

8. The method of claim 1, wherein the oxidant powder comprises $MoO_3$.

* * * * *